United States Patent [19]

Najm

[11] Patent Number: 4,958,651

[45] Date of Patent: Sep. 25, 1990

[54] IMPACT CUSHIONING AND AVOIDING DEVICE

[76] Inventor: Emile G. Najm, 1281 Whitmore, Bloomfield Hills, Mich. 48013

[21] Appl. No.: 349,166

[22] Filed: May 9, 1989

[51] Int. Cl.[5] ..... A45B 9/04

[52] U.S. Cl. ..... 135/82; 135/85; 135/65; 135/DIG. 11

[58] Field of Search ..... 135/82, 85, 84, DIG. 11, 135/65, 75, 76, 77, 67, DIG. 9; 248/129, 130, 131, 108.8; 297/5, DIG. 4; 280/78; 16/45, 24

[56] References Cited

U.S. PATENT DOCUMENTS

| | | | |
|---|---|---|---|
| 788,541 | 5/1905 | Kunkel | 135/82 |
| 1,527,239 | 2/1925 | Vaughan et al. | 135/85 |
| 1,733,430 | 10/1929 | Shahan | 135/82 |
| 2,590,052 | 3/1952 | Stuits | 135/85 |
| 2,802,479 | 8/1957 | Hickman | 135/65 |
| 2,899,968 | 8/1959 | Reichenbach | 135/65 |
| 3,040,371 | 6/1962 | Rice et al. | 16/45 |
| 3,158,162 | 11/1964 | Reel | 135/82 |
| 3,757,383 | 9/1973 | Iiyoshi | 16/45 |
| 3,906,971 | 9/1975 | Burnstine | 135/65 |
| 3,997,938 | 12/1976 | Pinaire et al. | 16/45 |
| 4,094,330 | 6/1978 | Jong | 135/67 |
| 4,559,962 | 12/1985 | Marchiano | 135/85 |

FOREIGN PATENT DOCUMENTS

| | | | |
|---|---|---|---|
| 509837 | 10/1930 | Fed. Rep. of Germany | 135/65 |
| 624246 | 12/1933 | Fed. Rep. of Germany | 135/82 |
| 2547721 | 12/1984 | France | 135/67 |
| 1524082 | 9/1978 | United Kingdom | 135/85 |

*Primary Examiner*—Richard E. Chilcot, Jr.
*Assistant Examiner*—Caroline D. Dennison
*Attorney, Agent, or Firm*—Daniel H. Bliss

[57] ABSTRACT

A device for a mobility cane which assists in the cushioning of impact and the avoidance of obstacles. The impact cushioning component can be adapted at either end of the cane or built into any portion along the length of the cane.

9 Claims, 8 Drawing Sheets

IMPACT CUSHIONING AND AVOIDING DEVICE

BACKGROUND -- FIELD OF INVENTION:

This invention relates to the use of mobility canes utilized by the visually impaired and more particularly to an impact cushion adapted to be mounted on either end of a mobility cane, the bottom end or the handle end. It can also be built into any portion of the cane along its entire length. The impact-avoiding component is a rounded tip capable of rotating in two axes, one parallel to, and another generally perpendicular to the axis of the cane. This device will reduce the danger of the cane impacting the user when the cane is suddenly blocked and reduce the tiring of the wrist as a result of extended use.

The impact-cushioning and the impact-avoiding features can be utilized separately or in combination. However, when the two features are used in combination, they cooperate to be mutually beneficial, that is each feature is more effective in combination than if it were used alone.

BACKGROUND -- DESCRIPTION OF PRIOR ART

Visually impaired persons use mobility canes in a scanning pattern to investigate the surface of the ground prior to stepping on that portion of that ground. The use of a solid cane as presently in use is successful when the ground surface is paved and without obstructions or irregularities. As expected this condition is rarely encountered. When the movement of the cane is suddenly blocked by an obstruction or an irregularity, the user experiences an impact transmitted through the cane which in some cases causes the cane to drop from the hand of the user and In other cases the cane collides with the body of the user resulting in bodily harm and excruciating pain. The use of a large tip or wheel or caster at the bottom end of the cane reduces the frequency of the occurrence of the shock but does not eliminate or totally ameliorate the effect of the shock when it occurs.

OBJECTS AND ADVANTAGES

Accordingly I claim the following as objects and advantages for the invention to overcome the aforementioned prior art problems. The Impact Cushion can be adapted to either the bottom tip of the mobility cane or to the top end and incorporated with the handle or built into any portion of the cane along its entire length. The impact avoiding feature provides smoother scanning because of the rounded tip which is capable of rotating over the user's path with minimum friction, and reduces wear of the tip. This invention is superior to the conventional caster design because the mounting of the rotating parts is internal and is not susceptible to jamming from picking up debris. Also, the combination of impact cushioning and impact avoiding improves the effect of both features. Because of the spring effect, the rounded tip skips over irregularities and because of the rounded tip, the demand on the cushioning effect is reduced.

During the normal procedure of using the mobility cane the cane tip sticks into all kinds of irregularities, grooves as well as projections, even on paved surfaces. This sudden blocking of the tip slows down the user and exposes the user to bodily injury and excessive tiring of the wrist. The Impact Cushioning and avoiding device smoothes the shocks and provides the user enough time to react in order to avoid being hurt by the cane when it is suddenly blocked and reduces the tiring of the wrist because of the smoother scanning operation. In addition the improved scanning results in a more confident and faster walk.

It is a specific object of the invention to provide an impact cushioning and avoiding device for use with a mobility cane of the type used by the visually impaired and can either be a built-in or an add-on device which can be installed without the use of tools. The reader will find further objectives and advantages of the invention in the appended description, drawings and claims.

DRAWING FIGURES

Figure 1:
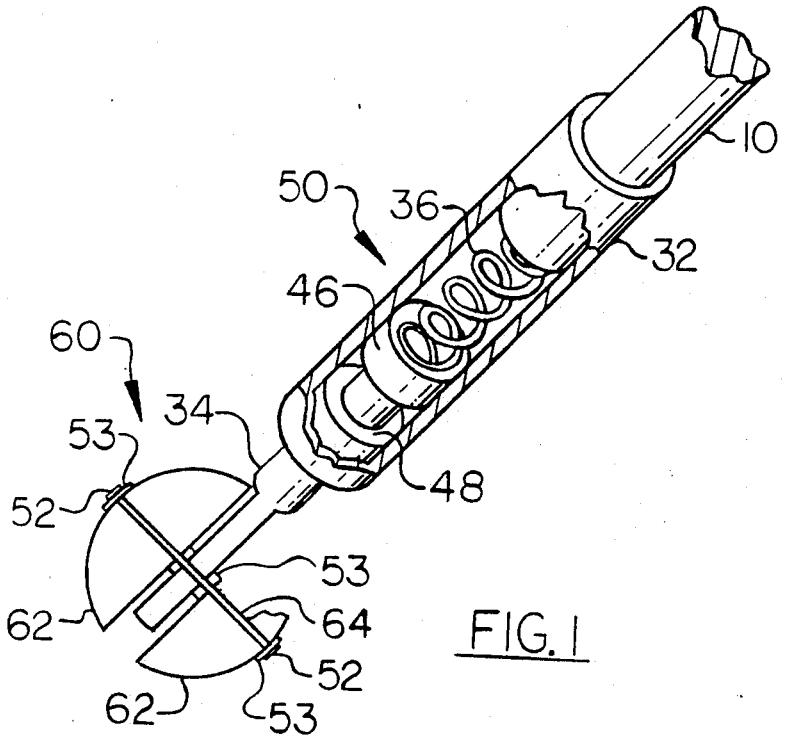
FIG. 1 is a perspective view of the bottom portion of a mobility cane in combination with the presently preferred embodiment of the Impact Cushioning and avoiding device adapted to the bottom end of mobility cane as an add-on device in accordance with the present invention.

DRAWING REFERENCE NUMERALS 10 mobility cane
12 handle of mobility cane
20 Impact cushion Device (built in handle)
30 Impact Cushion Device (built in cane)
32 sleeve
34 shaft
36 spring
38 cable
40 slot
42 screw
44 cover
46 piston
48 bushing
49 cap-bushing
50 Impact Cushion (add-on to bottom of mobility cane)
52 fastener
53 washer
54 pin
55 threaded rod
58 spacer
60 Impact Avoiding rounded tip
65 propeller axle
66 insert
70 Impact Avoiding rounded Tip with insert
72 Triangular insert
74 integral axle
80 Impact Avoiding rounded Tip with Triangular insert
90 Impact Avoiding rounded Tip with T connector
92 Impact Avoiding rounded Tip with propeller axle

DETAILED DESCRIPTION OF THE PREFERRED EMBODIMENTS

FIG. 1 illustrates the bottom portion of a mobility cane 10 shown in combination with the presently preferred embodiment of the Impact Cushion 50 and the Impact Avoiding Rounded tip 60 in accordance with the invention.

The Impact Cushion 50 comprises a sleeve 32, accepting into its first end telescopically the first end of shaft 34 and a spring 36 urging the shaft 34 outwardly from the sleeve 32, and piston 46 which is attached to the first end of shaft 34 and bushing 48 which is attached to the inside of the first end of sleeve 32 as means for retaining the shaft 34 slidable inside sleeve 32 against spring 36 The second end of sleeve 32 rigidly accepting the bottom end of mobility cane 10 The relative length of cane 10 and shaft 34 can be varied so that Impact Cushion 50 is in effect located at any place along the length of mobility cane 10.

The Impact Avoiding Rounded tip 60 comprises an axle 64 inserted through a diametrical hole in the second end of shaft 34 providing a rotation axis perpendicular to the elongated dimension of the mobility cane 10 for the two spherical segments 62 which are attached either rigidly or rotatable to axle 64 using fasteners 52 and washers 53, whereby the two spherical segments 62, in combination with axle 64 and shaft 34 are capable of rotating about two perpendicular axes, one parallel and 62 which are attached either rigidly or rotatable to axle 64 using fasteners 52 and washers 53, whereby the two spherical segments 62, in combination with axle 64 and shaft 34 are capable of rotating about two perpendicular axes, one parallel and another perpendicular to the elongated axis of the cane 10. Shaft 34 may be flattened to allow the two spherical segments 62 to be close together for smoother rolling.

Figure 2:
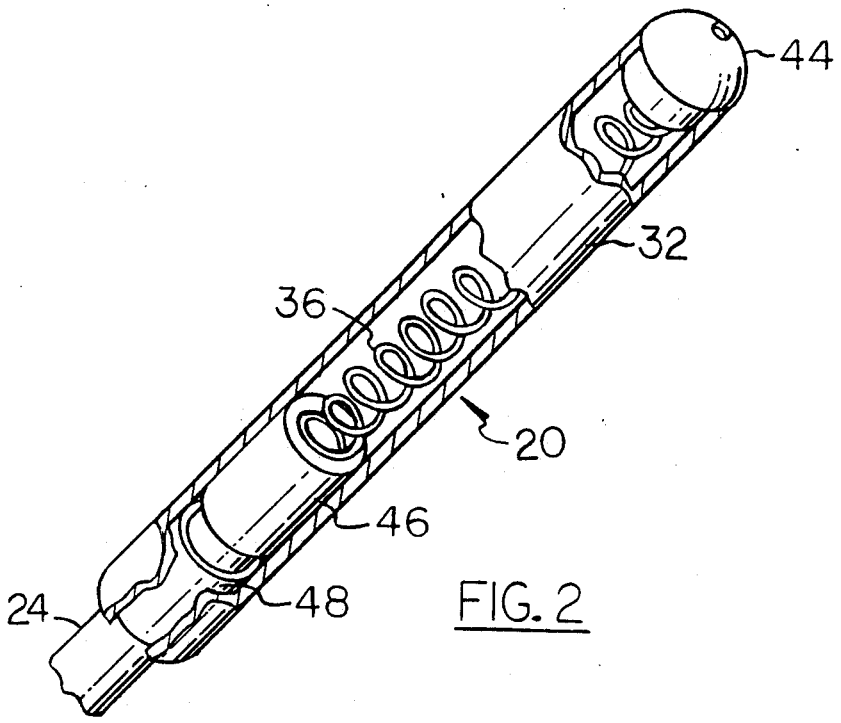
FIG. 2 is a perspective view of the top portion of a mobility cane in combination with a similar embodiment of the Impact Cushioning feature adapted to the top end of the mobility cane and incorporated with the handle.

FIG. 2 illustrates a similar embodiment of the Impact Cushion 20 incorporating the handle 12. The top end of the mobility cane 10 is inserted telescopically into the first end of sleeve 32 against spring 36 urging the top end of mobility cane 10 outwardly from sleeve 32, and a spring reaction member, cover 44, is attached to the second end of sleeve 32. The piston 46 is attached to the top of cane 10 and bushing 48 is attached to the inside of the first end of sleeve 32. This arrangement retains the top end of the mobility cane 10 slidable inside the sleeve 32.

Figure 3:
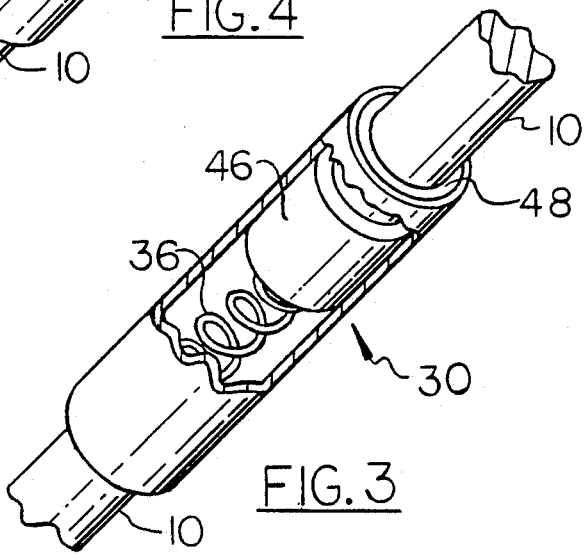
FIG. 3 is a perspective view of the bottom portion of a mobility cane in combination with another similar embodiment of the Impact Cushioning feature as a built in device in accordance with the present invention. It can be adapted to any portion of the mobility cone along its entire length.

FIG. 3 illustrates the bottom portion of a mobility cane 10 shown in combination with a similar embodiment of the impact Cushion 30 as a built-in device in accordance with the invention. The Impact Cushion 30 comprising a sleeve 32 having two ends, a first end for accepting telescopically the bottom end of cane 10, a spring 36 urging cane 10 telescopically outward from sleeve 32, and the means for retaining the bottom end of cane 10 slidable inside the sleeve 32 against the spring 36, comprising a piston 46 which is attached to the bottom end of cane 10 and inserted slidable into the first end of sleeve 32, and a bushing 48 telescopically accepting cane 10 and attached to the inside of the first end of sleeve 32. The second end of sleeve 32 accepts rigidly either another portion of the mobility cane 10 or cover 44. The only difference between this embodiment and that of FIG. 1 is that in FIG. 3 shaft 34 is not required but instead cane 10 is the sliding element. Again, the impact cushion 30 can be adapted to any portion of the mobility cane 10 along its entire length.

Figure 4:
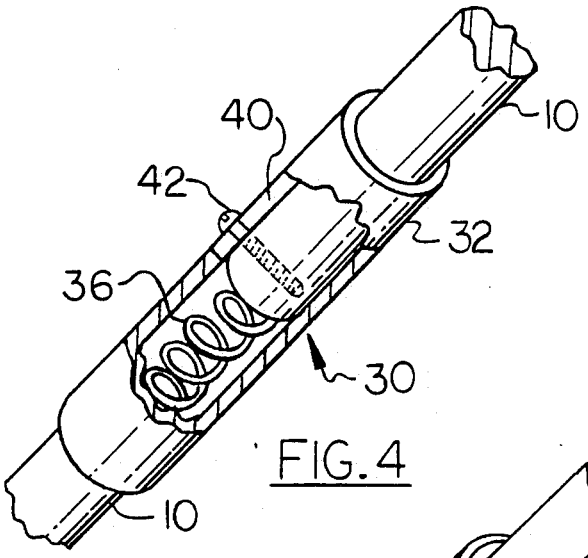
FIG. 4 is a perspective view of the bottom portion of a mobility cane in combination with another embodiment of the Impact Cushioning feature as a built-in device in accordance with the present invention utilizing a slot and screw to keep the components in the required relationship.

FIG. 4 illustrates another embodiment of the Impact Cushion 30 utilizing slot 40 cut axially in sleeve 32 and screw 42 attached radially to cane 10 through slot 40 to limit the travel of cane 10 inside sleeve 32.

Figure 5:
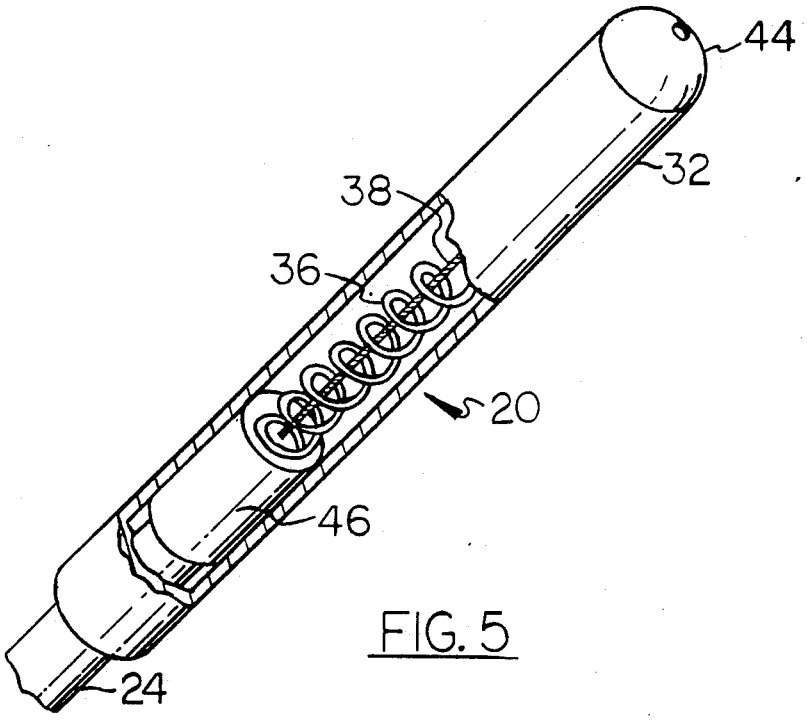
FIG. 5 is a perspective view of the top portion of a mobility cane in combination with another embodiment of the Impact Cushioning feature adapted to the handle end of the mobility cane utilizing a cable to retain the components in the required relationship.

FIG. 5 illustrates another embodiment of the Impact Cushion 20 utilizing a cable 38 having one end attached to cover 44 which is attached to the second end of sleeve 32, with the first end of sleeve 32 accepting telescopically cane 10. The second end of cable 38 is attached to piston 46 which is attached, either rigidly or rotatable, to the top end of mobility cane 10 if rotation between cane 10 and sleeve 32 is desired.

Figure 6:
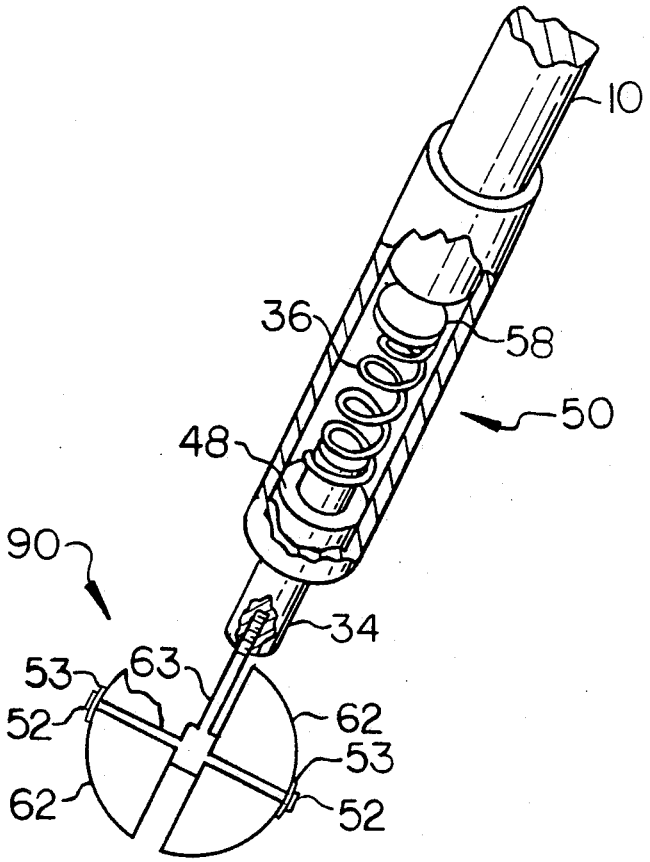
FIG. 6 is a perspective view showing another alternative embodiment of an Impact Cushion and Avoiding device utilizing an interference fit between the shaft and the spring replacing the piston to retain the components of the impact cushioning feature in the required relationship, with an Impact Avoiding rounded tip utilizing a T-connector to minimize the gap between the two spherical segments.

FIG. 6 illustrates the Impact Avoiding Rounded tip 90 comprising a T-connector 63 which is attached to the second end of shaft 34 to provide the two spherical segments 62 a rotation axis perpendicular to the elongated dimension of the cane 10 whereby the two spherical segments 62, in combination with T-connector 63 and shaft 34 are capable of rotating about two perpendicular axes, one parallel to, and the other perpendicular to, the elongated axis of the cane 10. The T-connector provides means for mounting the two spherical segments 62 in a close proximity for smoother rolling.

Figure 7:
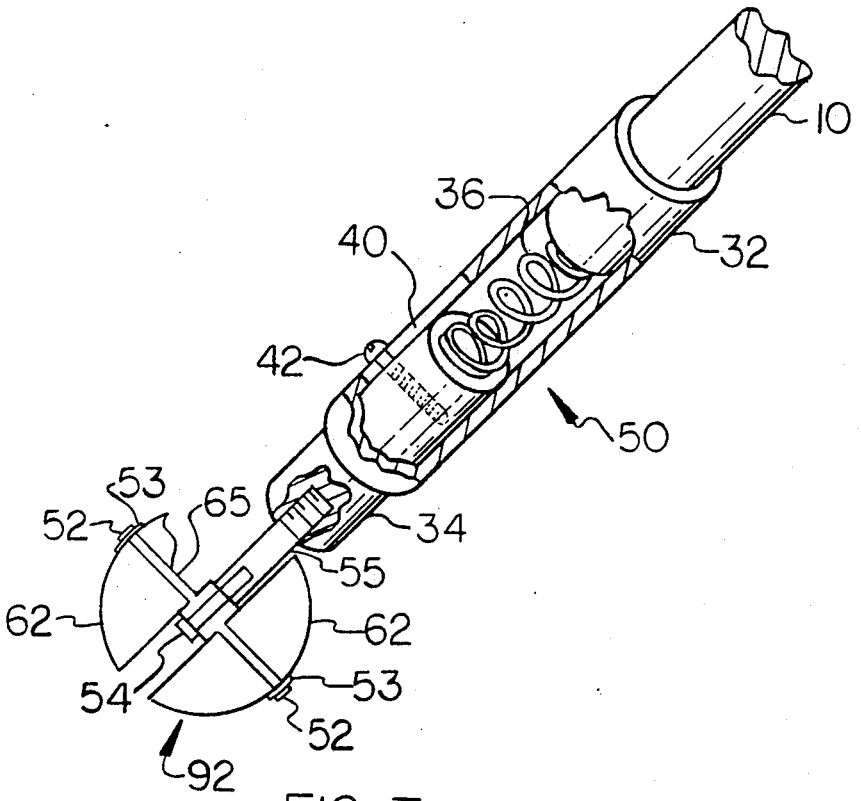
FIG. 7 is a perspective view showing an alternative embodiment of the Impact Avoiding rounded tip utilizing a propeller axle so that the tip is capable of rotating about two axes, one parallel and a second generally perpendicular to the elongated dimension of the cane.

FIG. 7 illustrates the Impact Avoiding Rounded tip 92 comprising a propeller axle 65 attached rotatable to the second end of shaft 34 to provide the two spherical segments 62 two rotation axes, one perpendicular to the elongated dimension of the cane 10, and the other parallel to the elongated dimension of the cane 10, whereby the two spherical segments 62, in combination with propeller axle 65 are capable of rotating about two perpendicular axes, one parallel and the other perpendicular to the elongated axis of the cane 10. The pin 53 and threaded rod 55 provide means for mounting the two spherical segments 62 in a close proximity for smoother rolling. Also, this embodiment can be attached directly to the bottom of cane 10 either without the Impact Cushioning feature or when the Impact Cushioning feature is incorporated with the handle.

Figure 8:
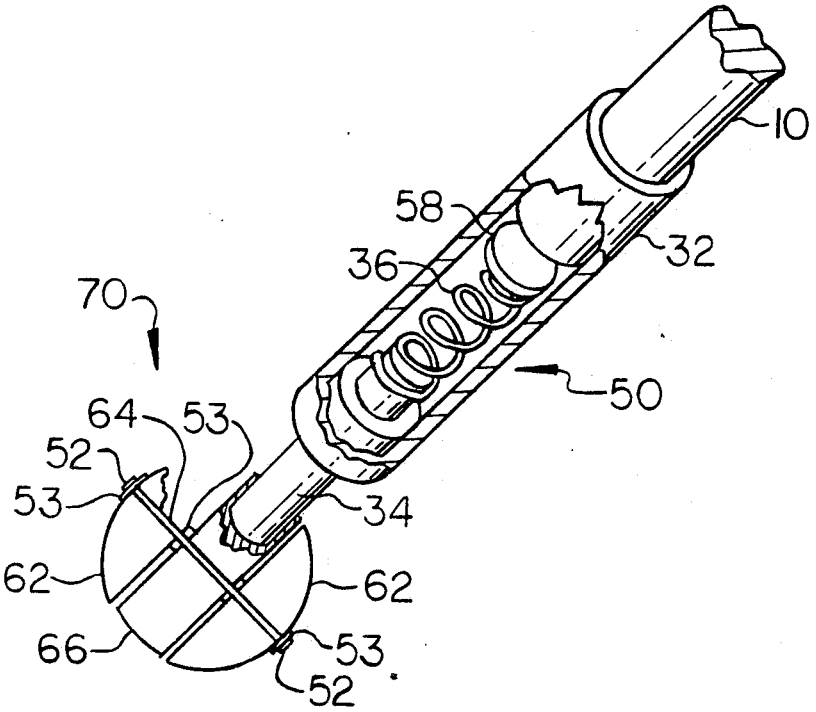
FIG. 8 is a perspective view showing an alternative embodiment of the Impact Avoiding rounded tip utilizing an insert to eliminate the gap between the two spherical segments to provide smoother rolling.

FIG. 8 illustrates the Impact Avoiding Rounded tip 70 comprising an insert 66 having a radial hole for accepting rigidly or rotatable the second end of shaft 34 and having an axial hole for accepting axle 64 rotatable, and the two spherical segments 62 attached either rigidly or rotatable to axle 64 with rotation axis perpendicular to the elongated dimension of the cane 10. The insert 66 fills the gap between the two spherical segments which results in smoother rolling.

Figure 9:
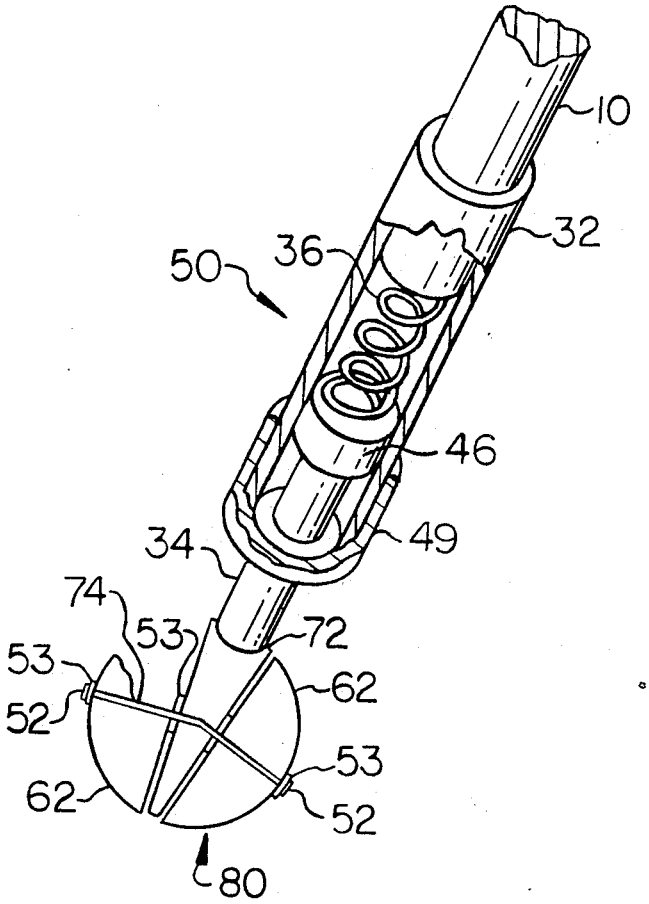
FIG. 9 is a perspective view showing another alternative embodiment of the Impact Avoiding rounded tip utilizing a Triangular insert to eliminate the gap between the two spherical segments in order to provide smoother rolling. In addition it shows the use of a cap-bushing in place of the internally-mounted bushing to keep the parts of the Impact cushioning device in the required relationship.

FIG. 9 illustrates the Impact Avoiding Spherical Tip 80 comprising a Triangular insert 82 having a radial hole for accepting rigidly or rotatable the second end of shaft 34 and having integral axles 74 for attaching the two spherical segments 62 rotatable with rotation axes perpendicular to the two adjacent sides of the Triangular insert 72. In this arrangement the insert does not touch the ground as in the arrangement of FIG. 8 which results in smoother rolling and reduced wear.

The add-on embodiment of the Impact Cushion 50 shown in FIG. 1 can be adapted to the top end of the mobility cane 10 by replacing the Impact Avoiding Rounded tip 60 and by attaching handle 12 to the second end of shaft 34 and the sleeve 32, accepting in the first end telescopically the first end of shaft 34 and a spring 36 urging the shaft 34 outwardly from the sleeve 32, and piston 46 and bushing 48 provide means for retaining the shaft 34 inside sleeve 32 against spring 36 as described above. The second end of sleeve 32 rigidly accepts the top end of cane 10. The means of retaining the end of the cane 10 or the shaft 34 slidable inside the sleeve 32 against the spring 36 can be accomplished in many ways. FIG. 1 and FIG. 3 illustrate the method comprising the piston 46 attached rigidly or rotatable to shaft 34 or cane 10, and bushing 48 attached to the inside of the first end of sleeve 32. Another means for retaining the end of cane 10 or shaft 34 slidable inside the sleeve 32 against the spring 36 is illustrated in FIG. 4 comprising a slot 40 in the sleeve 32 parallel to the elongated dimension of the sleeve 32, and the screw 42 which attaches radially to cane 10 or shaft 34 through slot 40 so that the travel of the cane 10 or the shaft 34 inside the sleeve 32 is limited by the length of the slot 40. Other means comprise a cable 38 having a first end connected to cover 44 which is rigidly attached to the second end of sleeve 32 and having a second end connected to piston 46 which is either rigidly or rotatable attached to the first end of cane 10 or shaft 34 to retain the shaft 34 or the cane 10 inside the sleeve 32 against the spring 36 as shown in FIG. 5.

Manufacturing techniques can be employed to combine parts, change the configuration of parts or reduce the number of parts such as using cap bushing 49 in place of bushing 48 as shown in FIG. 9, or manufacturing piston 46 integrally with cane 10 or shaft 34, or manufacturing bushing 48 or cap bushing 49 integral with sleeve 32, or eliminating the need for piston 46 altogether by utilizing a screw fit or an interference fit between spring 36 and cane 10 or shaft 34 so that the spring provides the stop instead of the piston 46 as shown in FIG. 6.

OPERATION

Whether the Impact Cushion 50 is purchased as a handle add-on unit or as a bottom end of cane add-on unit to the mobility cane 10, the user performs this installation without the use of tools. Simply insert the end of cane 10 into the open end of sleeve 32. The addition of masking tape to the end of cane 10 prior to inserting into sleeve 32 may be required to achieve a press fit between cane 10 and sleeve 32.

CONCLUSION

While the description contains many specificities, the reader should not construe these as limitations on the scope of the invention but merely as exemplifications of the preferred embodiments thereof. Those skilled in the art can envision many other variations within the scope of the invention. For example those skilled artisans can readily change dimensions and shapes of the various embodiments. They can also make the device of alternative materials. They can make many other variations on the adjustments and mechanisms of FIG. 1 through FIG. 9. Accordingly the readers are requested to determine the scope of the invention by the appended claims and their legal equivalents and not by the examples which have been given. The invention is intended to embrace the above noted and all other alternatives, modifications and variations that fall within the spirit of the invention claimed.

I claim:

1. An impact cushion readily attachable to a mobility cane of the type utilized by the visually impaired to investigate the surface of the ground prior to stepping on that portion of the ground, the mobility cane having a cane, and a handle attached to the top end of the cane, said impact cushion softening the shock when the movement of the cane is suddenly blocked, said impact cushion comprising:

a sleeve having a first end and a second end, said first end adaptable telescopically about one end of the cane, a shaft telescopically received within said second end of said sleeve and moveable relative to the sleeve, a spring means disposed within said sleeve for resiliently urging said shaft telescopically outwardly relative to said second end of said sleeve, a bushing attached to said second end of said sleeve for retaining said shaft slidable inside said sleeve.

2. The impact cushion set forth in claim 1 wherein said one end of said cane is the bottom end of said cane and further having a rounded tip attached to the end of said shaft.

3. The impact cushion set forth in claim 1 wherein said one end of said cane is the bottom end of said cane and further having a rounded tip comprising two spherical segments attached to an axle attached rotatable to the end of said shaft with a rotation axis generally perpendicular to the elongated dimension of said cane.

4. The impact cushion set forth in claim 1 wherein said one end of said cane is the bottom end of said cane and further having a rounded tip comprising two spherical segments attached rotatable to an axle with a rotation axis parallel to the elongated dimension of said axle and said axle is attached rotatable to the end of said shaft with a rotation axis parallel to the elongated dimension of said cane.

5. The impact cushion set forth in claim 1 wherein said one end of said cane is the top end of the cane and further said shaft incorporates the handle of the cane.

6. An impact cushion readily attachable to a mobility cane of the type utilized by the visually impaired to investigate the surface of the ground prior to stepping on that portion of the ground, the mobility cane having a cane, and a handle attached to the top end of the cane, said impact cushion softening the shock when the movement of the cane is suddenly blocked, said impact cushion comprising:

a sleeve having a first end and a second end, said first end adaptable telescopically about one end of the cane, a spring means disposed within said sleeve for resiliently urging the end of the cane telescopically outwardly relative to said sleeve, a spring reaction member attached to said second end of said sleeve, and retention means for retaining the end of the cane slidable inside said sleeve; and said retention means comprising a piston attached to said one end of said cane inserted slidable into said first end of said sleeve and a bushing telescopically accepting said one end of said cane and attached rigidly to the said first end of said sleeve so as to retain the said end of cane from sliding out of said first end of said sleeve.

7. An impact cushion readily attachable to a mobility cane of the type utilized by the visually impaired to investigate the surface of the ground prior to stepping on that portion of the ground, the mobility cane including a cane, and a handle attached to the top end of the cane, said impact cushion softening the shock when the movement of the cane is suddenly blocked, said impact cushion comprising:

a sleeve having a first end and a second end adaptable telescopically about one end of the cane, a shaft having first and second ends and telescopically received within said first end of said sleeve and moveable relative to said sleeve, a spring means disposed within said sleeve for resiliently urging said first end of said shaft telescopically outwardly relative to said sleeve, and retention means for retaining said shaft slidable inside said sleeve; and said retention means comprising a piston attached to said second end of said shaft inserted slidable into said sleeve and a bushing telescopically accepting said shaft and attached rigidly to said first end of said sleeve so as to retain slidable the said second end of said shaft inside said sleeve.

8. For use with a mobility cane of the type utilized by the visually impaired to investigate the surface of the ground prior to stepping on that portion of the ground, comprising a cane, and a handle attached to the top end of the cane, an impact avoidance device to reduce the frequency of occurrence of shock from the sudden blocking of the movement of said cane, said impact avoiding device comprising:

a rounded tip having two spherical segments attached to an axle with a rotation axis parallel to the elongated dimension of said axle and said axle is attached rotatable to the bottom end of the cane with a rotation axis parallel to the elongated dimension of the cane.

wherein said rounded tip further having a triangular insert filling the gap between said two spherical segments and further having two axles each mounted perpendicular to each of two adjacent sides of said triangular insert for attaching said spherical segments rotatable and having a hole in the third side of said triangular insert for accepting said bottom end of cane rotatable and retention means keeping said bottom end of cane rotatable inside said insert.

9. An impact cushion readily attachable to a mobility cane of the type utilized by the visually impaired to investigate the surface of the ground prior to stepping on that portion of the ground, the mobility cane having a cane, and a handle attached to the top end of the cane, said impact cushion softening the shock when the movement of the cane is suddenly blocked, said impact cushion comprising:

a sleeve having a first end and a second end, said first end adaptable telescopically about one end of the cane, a spring means disposed within said sleeve for resiliently during the end of the cane telescopically outwardly relative to said sleeve, a spring reaction member attached to said second end of said sleeve, and retention means for retaining the end of the cane slidable inside said sleeve;

said retention means comprising a piston attached to said one end of the cane inserted slidable into said first end of said sleeve and a cable fastening said spring reaction member to said piston so as to retain the end of the cane inside said sleeve against said spring.

* * * * *

UNITED STATES PATENT AND TRADEMARK OFFICE

CERTIFICATE OF CORRECTION

PATENT NO. : 4,958,651

DATED : September 25, 1990

INVENTOR(S) : Emile G. Najm

It is certified that error appears in the above-identified patent and that said Letters Patent is hereby corrected as shown below:

Column 1, Line 36, "In" should be --in--

Column 2, Line 1, "smoothes" should be --smooths--

Column 2, Line 32, "cone" should be --cane--

Column 3, Lines 48, 49, "36 The" should be --36, the--

Column 3, Line 50, after "cane 10" insert --.--

Column 3, Line 55, "diametrical" should be --diammetrical--

Column 8, Line 12, Claim 8, "." should be --,--

Column 8, Line 34, Claim 9, "during" should be --urging--

Signed and Sealed this

Third Day of March, 1992

*Attest:*

HARRY F. MANBECK, JR.

*Attesting Officer*

*Commissioner of Patents and Trademarks*